US007150460B2

(12) United States Patent
Williams

(10) Patent No.: US 7,150,460 B2
(45) Date of Patent: Dec. 19, 2006

(54) SKATEBOARD TRUCK

(76) Inventor: Alfred Williams, 126 Aptos Ave., San Francisco, CA (US) 94127

( * ) Notice: Subject to any disclaimer, the term of this patent is extended or adjusted under 35 U.S.C. 154(b) by 112 days.

(21) Appl. No.: 10/858,003

(22) Filed: Jun. 1, 2004

(65) Prior Publication Data

US 2005/0051984 A1 Mar. 10, 2005

(51) Int. Cl.
*A63C 17/02* (2006.01)

(52) U.S. Cl. ..... 280/87.042; 280/11.28

(58) Field of Classification Search ..... 280/87.042, 280/87.041, 11.27, 11.28, 11.221, 11.223; 301/5.7

See application file for complete search history.

(56) References Cited

U.S. PATENT DOCUMENTS 2,617,688 A * 11/1952 Lee ..... 301/5.7
3,235,282 A 2/1966 Bostick
3,862,763 A 1/1975 Ware
4,109,925 A 8/1978 Williams et al.
4,278,264 A * 7/1981 Lenz ..... 280/11.28
4,776,604 A 10/1988 Valdez et al.
5,052,702 A 10/1991 Chan
5,522,620 A 6/1996 Pracas
6,547,262 B1 * 4/2003 Yamada et al. ..... 280/11.28
2002/0125670 A1 9/2002 Stratton

* cited by examiner

*Primary Examiner*—Hau Phan
(74) *Attorney, Agent, or Firm*—Ronald E. Greigg

(57) ABSTRACT

A skateboard truck insert is positioned between an axle and a base plate of a skateboard truck to reduce turning radius but still maintain directional stability. The insert is comprised of an intermediary member with a pin on top for mating with a pin receiving hole in the base plate. The intermediary member includes a mounting portion with a through hole. First and second bushings are positioned on either side of the mounting portion. First and second washers are positioned against respective outer ends of the bushings. A bolt is positioned through the washers, bushings, and the hole for mating with the bolt receiving hole on the base plate of the truck. A pin receiving hole and a bolt receiving hole are positioned on a bottom of the intermediary member for respectively receiving a pin and a bolt extending from the axle of the truck.

21 Claims, 5 Drawing Sheets

SKATEBOARD TRUCK

CROSS REFERENCE TO RELATED APPLICATIONS

I claim the priority of patent application Ser. No. 10/658,244 filed on Sep. 9, 2003, now abandoned.

BACKGROUND OF THE INVENTION

1. Field of the Invention

The invention broadly relates to skateboards.

2. Prior Art

A skateboard is comprised of an elongated board with a pair of trucks attached underneath. Each truck is comprised of a base plate attached to the board, an axle attached to the base plate with a bolt, and wheels attached to the axle. The axle has an upwardly projecting pin which is positioned inside a pin receiving hole in the base plate. The bolt is positioned through an oversized hole in a mounting portion of the axle. The bolt is centered within the hole by resilient bushings on either side of the mounting portion. The bolt and the pin form a divergent angle in the direction towards the board. When the board is rolled about a longitudinal axis to either side by foot pressure, the axle is pivoted about the pin to steer the wheels in a corresponding direction. The trucks are mounted as mirror images of each other, so that they simultaneously steer in opposite directions in response to board roll.

The resilient bushings provide compliance to enable the bolt to move laterally within the hole in the mounting portion, and provide increasing roll resistance with increasing roll angle of the board. Roll resistance is determined by the hardness of the bushings, and the clamping force applied on the bushings by the bolt, which is adjustable for tuning roll resistance. The bushings must provide enough resistance to prevent the wheels from steering too easily, that is, to provide suitable directional stability. Higher resistance provides good directional stability but limits turning radius, whereas lower resistance enables a tight turning radius but sacrifices some directional stability.

BRIEF SUMMARY OF THE INVENTION

A skateboard truck insert is positioned between an axle and a base plate of a skateboard truck to reduce turning radius but still maintain directional stability. The insert is comprised of an intermediary member with a pin on top for mating with a pin receiving hole in the base plate. The intermediary member includes a mounting portion with a through hole. First and second bushings are positioned on either side of the mounting portion. First and second washers are positioned against respective outer ends of the bushings. A bolt is positioned through the washers, bushings, and the hole for mating with the bolt receiving hole on the base plate of the truck. A pin receiving hole and a bolt receiving hole are positioned on a bottom of the intermediary member for respectively receiving a pin and a bolt extending from the axle of the truck.

DRAWING REFERENCE NUMERALS

| | |
|---|---|
| 10. | Truck Insert |
| 11. | Intermediary Member |
| 12. | Truck Insert Pin |
| 13. | Top |
| 14. | Mounting Portion |
| 15. | Through Hole |
| 16. | First Recess |
| 17. | Second Recess |
| 18. | Bushing |
| 19. | Bushing |
| 20. | First Washer |
| 21. | Second Washer |
| 22. | Truck Insert Bolt |
| 23. | Axle Pin Receiving Hole |
| 24. | Axle Bolt Receiving Hole |
| 25. | Bottom |
| 26. | Skateboard |
| 27. | Axle |
| 28. | Base Plate |
| 29. | Axle Bolt |
| 30. | Bolt Receiving Hole |
| 31. | Pin Receiving Hole |
| 32. | Axle Pin |
| 33. | Bushing |
| 34. | Bushing |
| 35. | Mounting Portion |
| 36. | Washer |
| 37. | Washer |
| 38. | Wheel |
| 39. | Wheel |
| 40. | Board |
| 41. | Arrow |
| 42. | Arrow |
| 43. | Arrow |
| 44. | Truck Insert |
| 45. | Skateboard |
| 46. | Axle |
| 47. | Base Plate |
| 48. | Intermediary Member |
| 49. | Pin Receiving Hole |
| 50. | Bolt Receiving Hole |
| 51. | Truck Insert Bolt |
| 52. | Mounting Portion |
| 53. | Truck Insert Pin |
| 54. | Bushing |
| 55. | Bushing |
| 56. | Washer |
| 57. | Washer |
| 58. | Axle Pin |
| 59. | Axle bolt |

DETAILED DESCRIPTION OF THE INVENTION

FIG. 1

Figure 1:
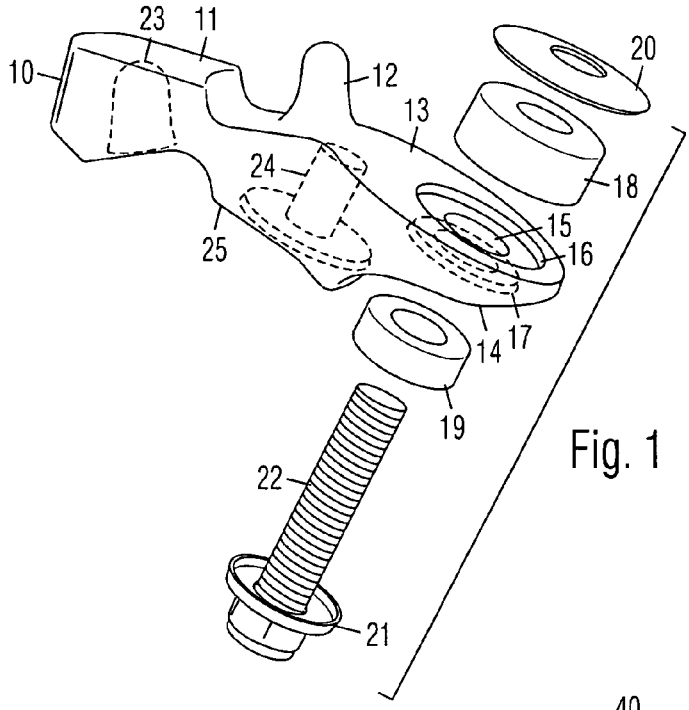
FIG. 1 is an exploded view of the present skateboard truck insert.

A skateboard truck insert 10 shown in FIG. 1 is arranged for being positioned between an axle and a base plate of a skateboard truck for reducing turn radius but still maintaining directional stability. Truck insert 10 is comprised of an intermediary member 11 with a truck insert pin 12 on a top 13 for mating with a pin receiving hole in the base plate. As shown in FIG. 1, truck insert pin 12 is provided with a rounded tip. Intermediary member 11 includes a mounting portion 14 with an oversized through hole 15, and recesses 16 and 17 on either side of mounting portion 14 coaxial with oversized through hole 15. Resilient first and second bushings 18 and 19 are for being positioned in a first recess 16 and a second recess 17 on either side of mounting portion 14. First cupped washer 20 and second cupped washer 21 are for being positioned against respective outer ends of bushings 18 and 19. A truck insert bolt 22 is for being positioned through washers 20 and 21, bushings 18 and 19, and oversized through hole 15 for mating with the bolt receiving hole on the base plate of the truck. A blind hole 23 with a rounded bottom portion and a threaded axle bolt receiving hole 24 are positioned on a bottom 25 of intermediary member 11 for respectively receiving an axle pin and an axle bolt extending from the top of the axle of the truck. Truck insert pin 12 and truck insert bolt 22 on top of intermediary member 11 are longitudinally offset from the blind hole or pin receiving hole 23 and bolt receiving hole 24 on the bottom of intermediary member 11.

FIGS. 2–3

Figure 2:
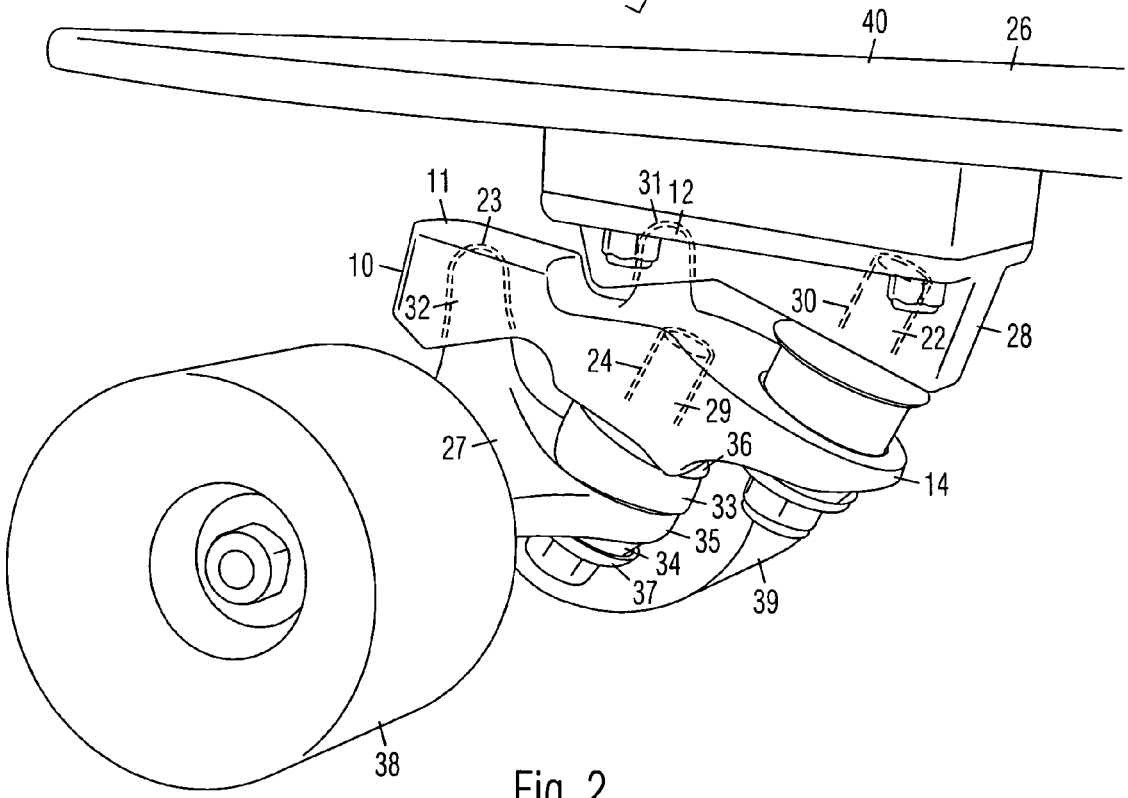
FIG. 2 is a side perspective view of the skateboard truck insert installed on a truck of a skateboard, wherein the truck is in a neutral steering position.

Truck insert 10 is shown in FIG. 2 installed on a skateboard 26. An axle 27 of skateboard 26 was previously detached from a base plate 28 of skateboard 26 by unscrewing an axle bolt 29 from a threaded bolt receiving hole 30 in base plate 28. Truck insert 10 has been attached to base plate 28 by positioning truck insert pin 12 in a pin receiving hole 31 in base plate 28, and screwing truck insert bolt 22 in bolt receiving hole 30 in base plate 28. Axle 27 has been attached to truck insert 10 by positioning an axle pin 32, which also has a rounded tip, in pin receiving blind hole 23 on truck insert 10, and screwing axle bolt 29 in bolt receiving hole 24 in truck insert 10. The pin receiving hole 31, like the hole 23 in the insert, is a blind hole with a rounded bottom portion to receive the rounded tip of truck insert pin 12.

Bushings 33 and 34 are positioned on the top and bottom of a mounting portion 35 of axle 27. Cupped washers 36 and 37 are positioned against the outer sides of bushings 33 and 34. Wheels 38 and 39 are attached to opposite ends of axle 27. Base plate 28 is attached to the bottom of a board 40. Another set of truck and truck insert (not shown) is attached to the other end of board 40 as a mirror image of the set shown.

Figure 3:
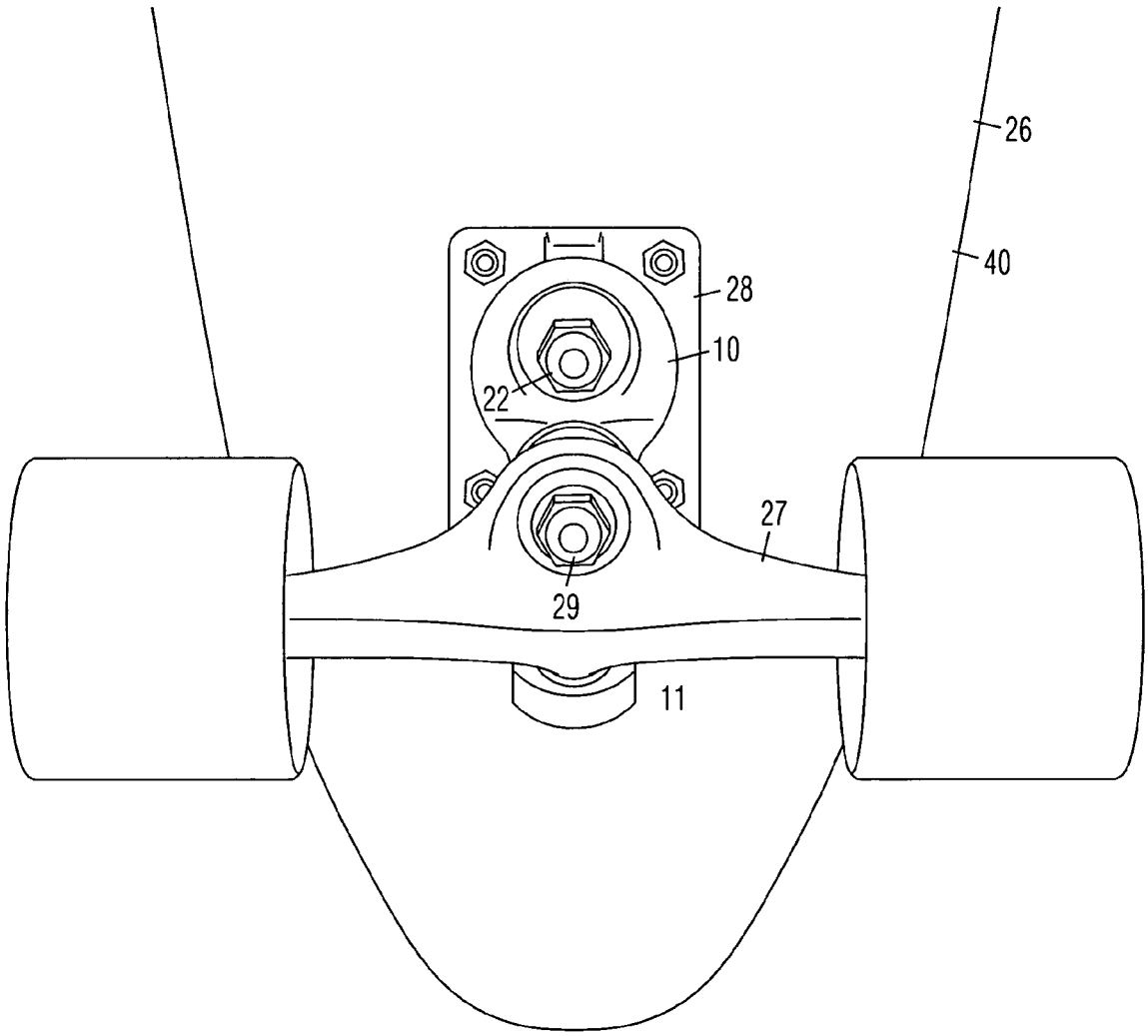
FIG. 3 is a bottom view of the truck insert and skateboard of FIG. 2.

Truck insert 10 and axle 27 are shown in a neutral position in the side view in FIG. 2 and the bottom view in FIG. 3. Bolts 22 and 29 may be tightened to reduce board roll resistance, and loosened to increase board roll resistance. Bolts 22 and 29 are preferably adjusted to provide a suitable amount of roll resistance to prevent wobbling, and therefore provide a level of directional stability comparable to before truck insert 10 is added.

FIGS. 4–5

Figure 4:
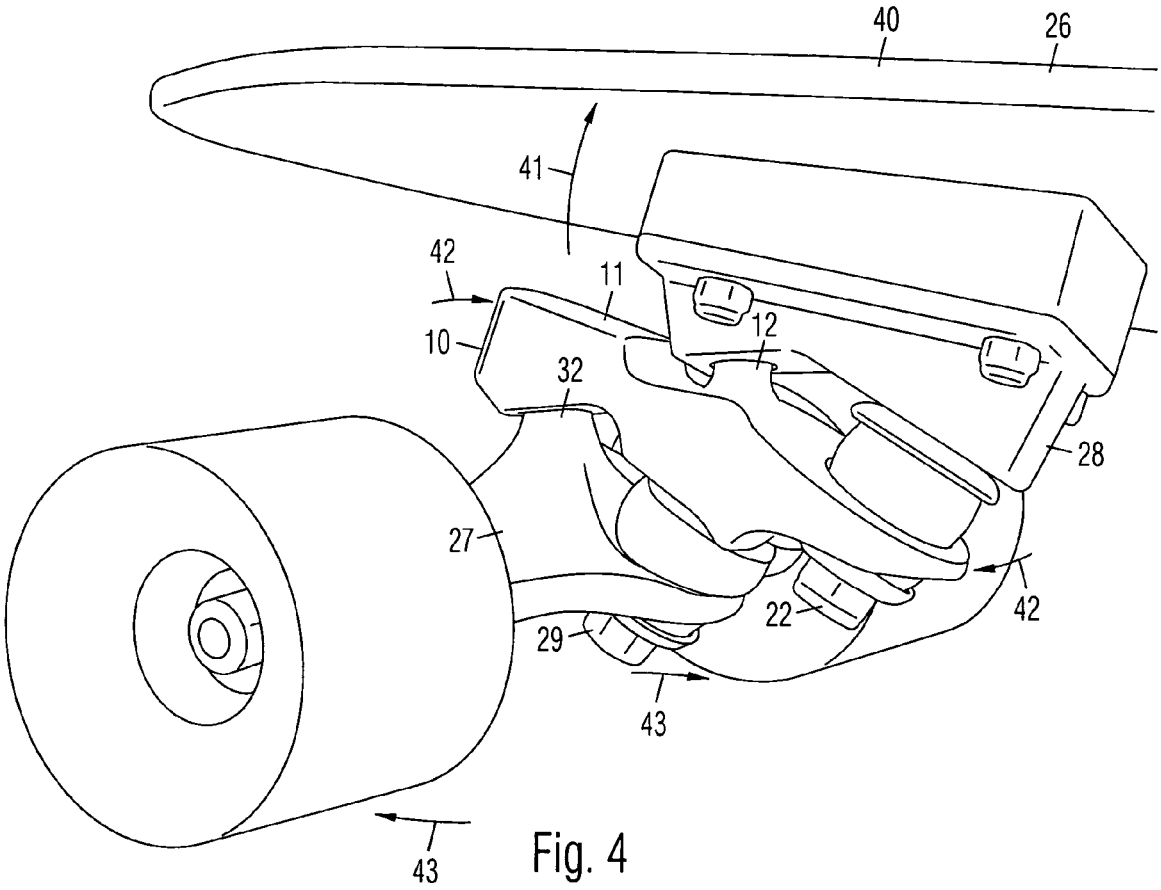
FIG. 4 is a side perspective view of the skateboard truck on the skateboard, wherein the truck is in a turned position.
Figure 5:
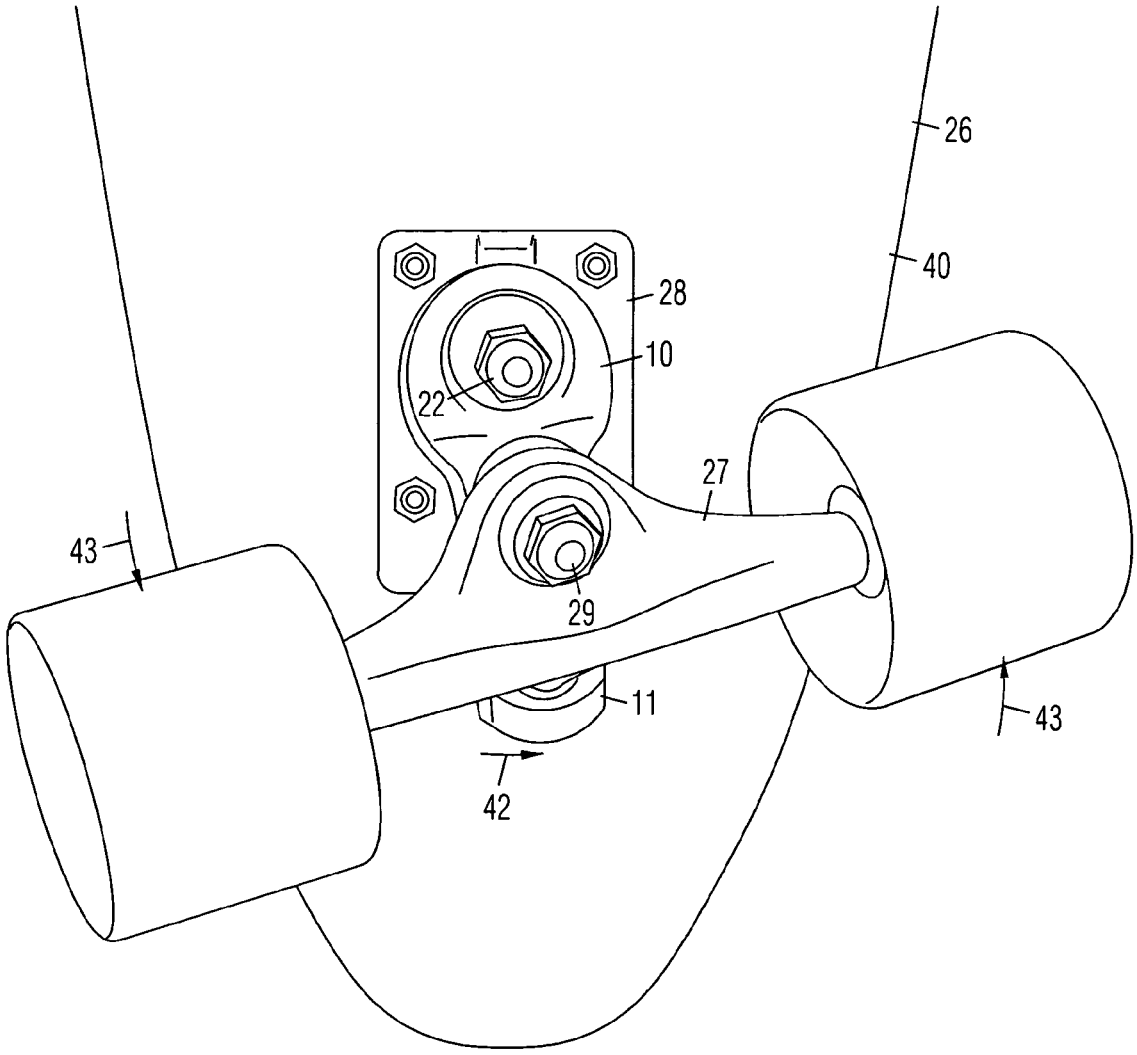
FIG. 5 is a bottom view of the truck insert and skateboard of FIG. 4.

Truck insert 10 and axle 27 are shown in a rotated condition in the side view in FIG. 4 and the bottom view in FIG. 5. In the example shown, board 40 of skateboard 26 is rolled to the right at about its longitudinal axis by foot pressure, as indicated by arrow 41. Truck insert 10 is rotated about truck insert pin 12 as indicated by arrow 42, and axle 27 is rotated about axle pin 32 in the same direction, as indicated by the arrows 43. The combined rotation of truck insert 10 and axle 27 significantly increases axle steering relative to the axle steering possible before truck insert 10 is installed. Therefore, turning radius is significantly reduced for better maneuverability without sacrificing directional stability.

FIG. 6

Figure 6:
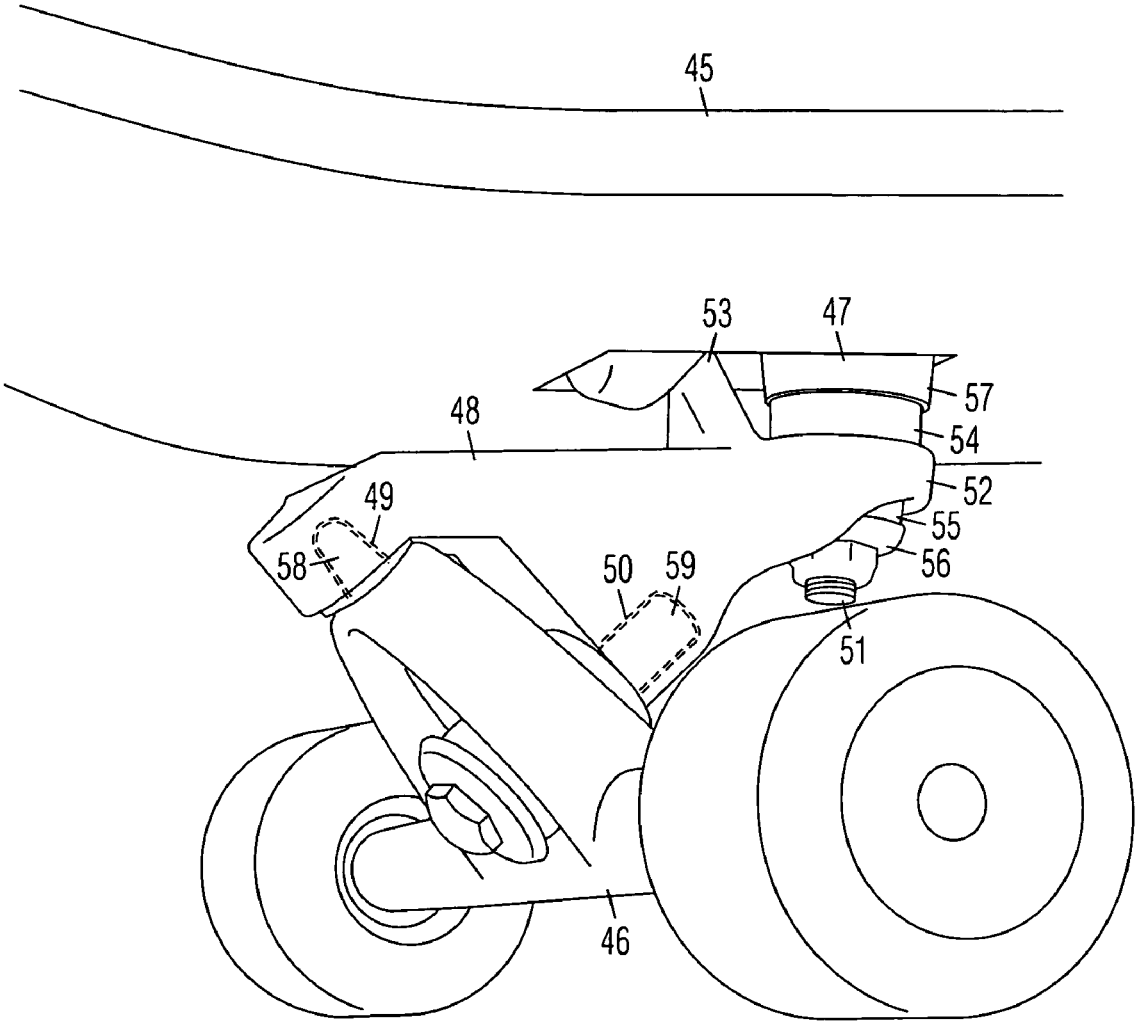
FIG. 6 is a side perspective of an alternative embodiment thereof.

An alternative truck insert 44 shown in FIG. 6 is attached to a different type of skateboard 45 with an axle 46 and a base plate 47. Axle 46 has been detached from base plate 47 and truck insert 44 has been positioned there between. Truck insert 44 is comprised of an intermediary member 48 with a pin receiving hole 49 and a bolt receiving hole 50 on a bottom side at approximately 90 degrees to each other. Truck insert 44 is further comprised of a truck insert bolt 51 positioned through a mounting portion 52 and a truck insert pin 53. Bushings 54 and 55 are positioned around bolt 51 on either side of mounting portion, and cupped washers 56 and 57 are positioned on the outside ends of respective bushings 54 and 55. Truck insert bolt 51 is secured in base plate 47, and truck insert pin 53 is positioned in base plate 47. An axle pin 58 on axle 46 is positioned inside pin receiving hole 49 in truck insert 44, and an axle bolt 59 is positioned inside bolt receiving hole 50 in truck insert 44.

Although the foregoing description is specific, it should not be considered as a limitation on the scope of the invention, but only as an example of the preferred embodiment. Many variations are possible within the teachings of the invention. For example, truck insert 10 maybe provided as part of a complete truck assembly which includes base plate 28, truck insert 10, and axle 27, or as part of a complete skateboard. Therefore, the scope of the invention should be determined by the appended claims and their legal equivalents, not by the examples given.

I claim:

1. A skateboard truck insert capable of being positioned between a base plate and an axle of a skateboard truck, said insert comprising: an intermediary member; a truck insert pin projecting from said intermediary member for positioning in a pin receiving hole in said base plate; a mounting portion at one end of said intermediary member with an oversized through hole; a blind hole at an end of said intermediary member opposite said one end for receiving an axle pin projecting from said axle; and an axle bolt receiving hole for receiving an axle bolt extending from said axle, said axle bolt receiving hole being spaced from said blind hole and being located in said intermediary member between the oversized through hole in said mounting portion and said blind hole.

2. The skateboard truck insert of claim 1, further including: a first resilient bushing and a second resilient bushing on either side of said mounting portion coaxial with said oversized through hole; a truck insert bolt positioned through said second resilient bushing, said oversized through hole, and said first resilient bushing for positioning in a bolt receiving hole in said base plate.

3. The skateboard truck insert of claim 2, wherein said truck insert pin and truck insert bolt are longitudinally offset from said blind hole and said axle bolt receiving hole.

4. The skateboard truck insert of claim 1, further including: a first recess and a second recess on either side of said mounting portion coaxial with said oversized through hole; a first resilient bushing and a second resilient bushing respectively positioned in said first recess and said second recess; a first washer and a second washer positioned against respective outer ends of said first resilient bushing and said second resilient bushing; and a truck insert bolt positioned through said second washer, said second resilient bushing, said oversized through hole, said first resilient bushing, and said first washer for positioning in a bolt receiving hole on said base plate.

5. The skateboard truck insert of claim 4, wherein said truck insert pin and truck insert bolt are longitudinally offset from said blind hole and said axle bolt receiving hole.

6. The skateboard truck insert of claim 1, wherein said blind hole has a rounded bottom.

7. The skateboard insert of claim 1, wherein said truck insert bolt can be positioned in said oversized through hole in said intermediary member, such that, movement and tilting of said bolt within said hole is possible without the sides of said truck insert bolt coming into contact with the sides of said oversized through hole.

8. The skateboard truck insert of claim 1, wherein said axle bolt receiving hole is a threaded hole.

9. A skateboard truck assembly, comprising: a base plate for attaching to a board of a skateboard, said base plate including: a pin receiving hole at one end of said base plate; and a bolt receiving hole at an end of said base plate opposite said one end; an intermediary member below said base plate, said intermediary member including; a truck insert pin projecting into said pin receiving hole in said base plate; a mounting portion with an oversized through hole; a blind hole for receiving an axle pin; and an axle bolt receiving hole spaced from said blind hole; said axle bolt receiving hole being located in said intermediary member between the oversized through hole in said mounting portion and said blind hole; a first resilient bushing and a second resilient bushing positioned on either side of said mounting portion coaxial with said oversized through hole; a truck insert bolt positioned through said second resilient bushing, said oversized through hole, and said first resilient bushing and secured in said bolt receiving hole on said base plate; an axle below said intermediary member for attaching a pair of wheels, said axle including: an axle pin projecting into said blind hole in said intermediary member; and an axle bolt extending from said axle into said axle bolt receiving hole in said intermediary member.

10. The skateboard truck assembly of claim 9, wherein said truck insert pin and truck insert bolt are longitudinally offset from said blind hole and said axle bolt receiving hole.

11. The skateboard truck assembly of claim 9, further including: a first recess and a second recess on either side of said mounting portion coaxial with said oversized through hole, wherein said first resilient bushing and said second resilient bushing are respectively positioned in said first recess and said second recess; and a first washer and a second washer positioned against respective outer ends of said first resilient bushing and said second resilient bushing.

12. The skateboard truck assembly of claim 9, wherein said axle further includes a second mounting portion with a second oversized through hole; a third resilient bushing and a fourth resilient bushing positioned on either side of said second mounting portion coaxial with said second oversized through hole; said axle bolt being positioned through said fourth resilient bushing, said second oversized through hole, and said third resilient bushing and secured in said axle bolt receiving hole in said intermediary member.

13. The skateboard truck assembly of claim 9, wherein said pin receiving hole in said base plate is a blind hole having a rounded bottom and said blind hole in said intermediate member also has a rounded bottom.

14. The skateboard truck assembly of claim 9, wherein said axle bolt receiving hole is a threaded hole.

15. A skateboard comprising:

aboard;

a base plate attached to said board, said base plate including a pin receiving hole at one end of said base plate and a bolt receiving hole at an end of said base plate opposite said one end;

an intermediary member below said base plate, said intermediary member including a truck insert pin projecting into said pin receiving hole in said base plate, a mounting portion with an oversized through hole, a blind hole for receiving an axle pin, and an axle bolt receiving hole spaced from said blind hole, said axle bolt receiving hole being located in said intermediary member between the oversized through hole in said mounting portion and said blind hole, a first resilient bushing and a second resilient bushing positioned on either side of said mounting portion coaxial with said oversized through hole, a truck insert bolt positioned through said second resilient bushing, said oversized through hole, and said first resilient bushing and secured in said bolt receiving hole on said base plate; and an axle below said intermediary member for attaching a pair of wheels, said axle including an axle pin projecting into said blind hole in said intermediary member; and an axle bolt extending from said axle into said axle bolt receiving hole in said intermediary member.

16. The skateboard of claim 15, wherein said truck insert pin and truck insert bolt are longitudinally offset from said blind hole and said axle bolt receiving hole.

17. The skateboard of claim 15, wherein said intermediary member further includes a first recess and a second recess on either side of said mounting portion coaxial with said oversized through hole, wherein said first resilient bushing and said second resilient bushing are respectively positioned in said first recess and said second recess; and a first washer and a second washer positioned against respective outer ends of said first resilient bushing and said second resilient bushing.

18. The skateboard of claim 15, wherein said axle further includes a second mounting portion with a second oversized through hole, a third resilient bushing and a fourth resilient bushing positioned on either side of said second mounting portion coaxial with said second oversized through hole, said axle bolt being positioned through said fourth resilient bushing, said second oversized through hole, and said third resilient bushing and secured in said axle bolt receiving hole in said intermediary member.

19. The skateboard of claim 15, wherein said pin receiving hole in said base plate is a blind hole having a rounded bottom and said blind hole in said intermediate member also has a rounded bottom.

20. The skateboard of claim 15, wherein said axle bolt receiving hole is a threaded hole.

21. The skateboard of claim 15, wherein a skateboard truck assembly comprising said base plate, said intermediary member and said axle is installed at one end of the board, and another identical truck assembly comprising said base plate, said intermediary member and said axle is installed at an end of the board opposite said one end of the board, such that, the two said truck assemblies are mounted as mirror images of each other on the board and are capable of simultaneously steering in opposite directions in response to board roll.

* * * * *